US006842155B1

(12) United States Patent
Yeh

(10) Patent No.: US 6,842,155 B1
(45) Date of Patent: Jan. 11, 2005

(54) LOW-COST COAXIAL CABLE FED INVERTED-L ANTENNA

(75) Inventor: Ming-Hau Yeh, Hsinchu (TW)

(73) Assignee: D-Link Corporation, Hsinchu (TW)

( * ) Notice: Subject to any disclaimer, the term of this patent is extended or adjusted under 35 U.S.C. 154(b) by 0 days.

(21) Appl. No.: 10/633,524

(22) Filed: Aug. 5, 2003

(51) Int. Cl.[7] ..... H01Q 9/04
(52) U.S. Cl. ..... 343/790; 343/791
(58) Field of Search ..... 343/790, 905, 343/715, 749, 792, 820, 850

(56) References Cited

U.S. PATENT DOCUMENTS 3,649,742 A * 3/1972 Tissot ..... 174/70 R
4,813,888 A * 3/1989 Tokizane et al. ..... 439/583
4,927,378 A * 5/1990 Song ..... 439/394
5,574,815 A * 11/1996 Kneeland ..... 385/101
6,281,856 B1 * 8/2001 Tang et al. ..... 343/790

* cited by examiner

*Primary Examiner*—Don Wong
*Assistant Examiner*—Chuc Tran
(74) *Attorney, Agent, or Firm*—Bacon & Thomas PLLC

(57) ABSTRACT

The present invention discloses a low-cost coaxial cable fed inverted-L antenna with a structure using only one coaxial cable and extending an internal conductor outside one end of the coaxial cable to a predetermined length outside an external conductor on the other end, and then bending the coaxial cable backward in an opposite direction along the external conductor and parallel to the direction of the external conductor to extend to a predetermined length outside to define a radiating member, which doesn't require additional components or any other manufacturing procedure, and will greatly lower the production and manufacturing costs of the antenna and improve the yield rate of production.

5 Claims, 5 Drawing Sheets

LOW-COST COAXIAL CABLE FED INVERTED-L ANTENNA

BACKGROUND OF THE INVENTION

1. Field of the Invention

The present invention relates to an antenna, more particularly to a coaxial cable fed inverted-L antenna for a simple and easy installation.

2. Description of the Related Art

In general, the dipole antenna 2 usually used in a traditional wireless communication device 1 (as shown in FIG. 1) is an coaxial sleeve antenna (as shown in FIG. 2); such dipole antenna 2 comprises a coaxial cable 10, and such coaxial cable 10 comprises an internal conductor 14 (or a symmetric axis); an external conductor 16 (or mask or ground); an insulated dielectric material 17 disposed between the internal conductor 14 and the external conductor 16 for the isolation such that the internal conductor 14 and the external conductor 16 constitute a so-called concentric conductor in electromagnetism. Further, the external edge of the coaxial cable 10 is wrapped by an insulating external skin 19 with one end coupled to a control circuit (not shown in the figure) of the wireless communication device 1, and the other end has a metal sleeve 18, such that the metal sleeve 18 is coaxial with the external conductor 16, and only the upper end of the metal sleeve 18 is connected to the external conductor 16, and the rest of the metal sleeve 18 is separated from the area of the external conductor 16 by the insulating external skin 19, instead of contacting with the external conductor 16. The internal conductor 14 is extended to an appropriate distance from another end of the coaxial cable 10, and the length of such distance is approximately equal to the length of the metal sleeve 18, but both of them are slightly shorter than a quarter of the wavelength of the operating frequency (¼ λ; where λ is the wavelength of the operating frequency), so that another coaxial conductor is formed between the metal sleeve 18 and the external conductor 16 to prevent the radioactive interference produced by the leaked current on the outer side of the external conductor 16, which constitutes a balance-unbalance (balun) converter in order to produce the expected antenna radiation by the coaxial cable sleeve antenna.

In general, an all-directional radiation filed antenna must be installed to a mobile or portable wireless communication device such as the present commonly-used mobile phone, so that such wireless communication device can maintain a 360 degrees azimuth communication. The aforementioned dipole antenna is the antenna commonly installed to such wireless communication device, and such dipole antenna is generally installed to receive or send high-frequency (HF), very high-frequency (VHF), and ultra high-frequency (UHF) signal or a wireless communication device, and its basic structure mainly uses a metal sleeve 18 on the coaxial cable sleeve antenna to design a balun converter. Further, to enhance the performance of the antenna and maintain the all-directional radiation field, a collinear structure is used to design such coaxial sleeve antenna.

Since the IEEE 802.11 wireless local area network protocol established in 1997, such protocol not only provides unprecedented functions on wireless communication, but also offers a solution for the mutual communication between different branded wireless products. Therefore such protocol opens up a new mileage to the development of wireless communication, and creates the demand of mobile communication products in the market, such that the development of wireless communication becomes much faster. Thus, in recent years, many wireless communication product designers and manufacturers have been expecting an antenna with a simple structure, easy installation, and low cost while developing a wireless communication device to receive or transmit the high-frequency (HF), very high-frequency (VHF), and ultra high-frequency (UHF) signals in order to effective lower the cost of the antenna which is used in such wireless communication products.

However, the present common high-frequency antennas sold in the market also includes a printed antenna production technology, design, and manufacture equivalent to the dipole antenna 2 in addition to the traditional coaxial cable sleeve antenna. Please refer to FIG. 3. Such the dipole antenna 2 comprises a dielectric substrate 20 in the shape of a board, a first printed circuit 22 and a second printed circuit 24 respectively printed on the front and back sides of the dielectric substrate 20, wherein the first printed circuit 22 printed in the front side acts as the signal transmission line with one end acting as the signal fed end 21 to connect to a control circuit (not shown in the figure) of a wireless communication device through an internal conductor 31 (or symmetric axis) of a coaxial cable 30, and another end of the first printed circuit 22 has a radiating member 25 extended to the corresponding side with an appropriate distance, and the length of such radiating member 25 is slightly shorter than a quarter of the wavelength of the operating frequency (¼ λ; where λ is the wavelength of the operating frequency). Further, the second printed circuit 24 on the back side of the dielectric substrate 20 being printed substantially in M-shape on the position corresponding to the signal feed end 21 at the front side, and the middle of the printed circuit 241 on the second printed circuit 24 connects to a ground end (not shown in the figure) on a control circuit of the wireless communication device through the external conductor 32 (or mask or ground) of the coaxial cable 30, and a concentric conductor is formed between the printed circuit 242 on both sides and the printed circuit 241 in the middle to prevent the radiation interference produced by the current leaked from the printed circuit 242 on both sides to constitute a balun converter, so that the antenna can produce the expected radiation effect as that of the aforementioned coaxial cable sleeve antenna.

Generally speaking, regardless of using the printed technology to produce the printed antenna or the traditional coaxial cable sleeve antenna, the features can meet the requirement, but the size of such traditional antenna is too big, or the structure is too complicated. For example, the traditional coaxial cable sleeve cable requires soldering the upper end of the metal sleeve with the external conductor of the coaxial cable, but the printed antenna requires an additional printed circuit board for its design and production. Furthermore, the coaxial cable and the printed circuit board of the antenna is soldered manually, not just increasing the production, manufacturing, and assembling costs, but also wasting the unnecessary installation space. In addition, since the microwave frequency has a shorter wavelength, therefore, the variation is relatively higher during the soldering process of manufacturing such dipole antenna, which will cause a low yield rate.

SUMMARY OF THE INVENTION

The primary objective of the present invention is to provide an antenna structure by using only one coaxial cable and extending an internal conductor outside one end of the coaxial cable to a predetermined length outside an external conductor on the other end, and then bending the coaxial cable in an opposite direction along the external conductor and parallel to the direction of the external conductor to extend to a predetermined length outside a radiating member. The present invention does not require any additional components at all as well as any other manufacturing procedure such as soldering. Therefore, this invention not only greatly lowers the production and manufacturing costs of the antenna, reduces the variation of production, improves the yield rate, but also effectively simplifies the working hours and procedure of the assembling to enhance the production and manufacturing efficiency.

Another objective of the present invention is to reduce the total length of the radiating member to a quarter of the wavelength of the operating frequency. Such length is almost one half of that of the traditional printed antenna or coaxial cable sleeve antenna. Therefore, the compact design of such antenna according to the present invention can effectively reduce the volume of wireless communication products to fit the trend for a light, thin, and small design.

BRIEF DESCRIPTION OF THE DRAWINGS

Other features and advantages of the present invention will become apparent in the following detailed description of the preferred embodiments with reference to the accompanying drawings, in which.

DETAILED DESCRIPTION OF THE PREFERRED EMBODIMENTS

Figure 1:
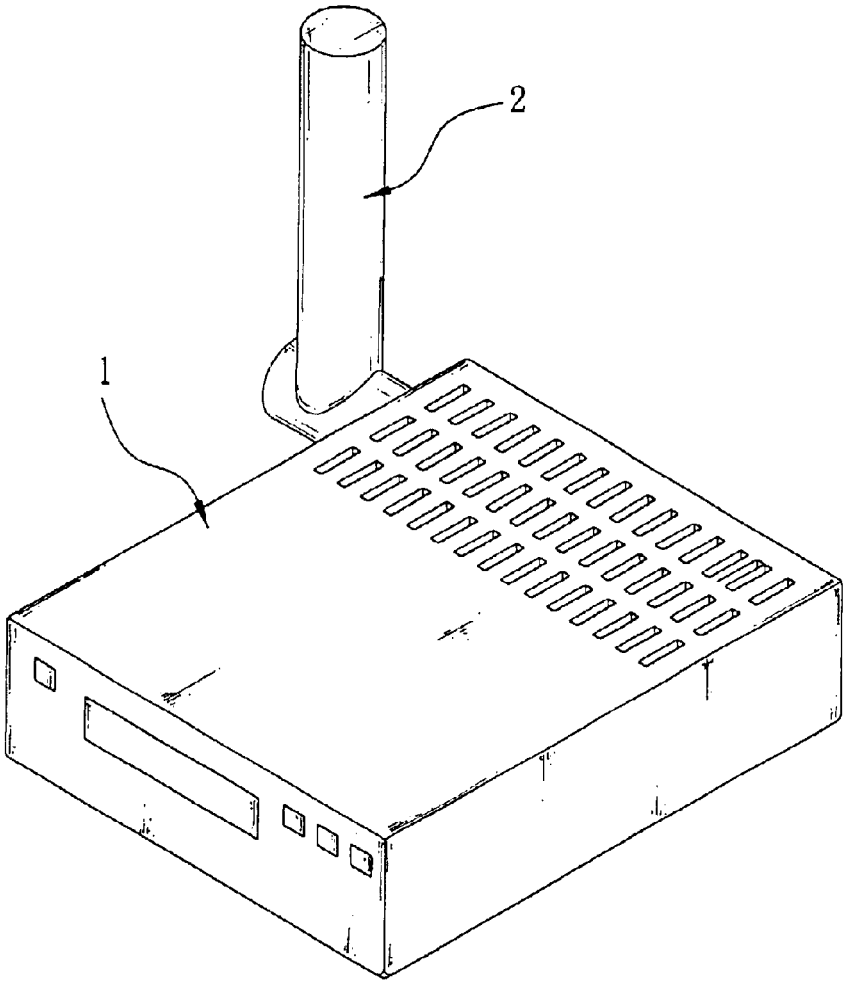
FIG. 1 (Prior Art)
FIG. 1 is an illustrative diagram of a traditional wireless communication device.
Figure 2:
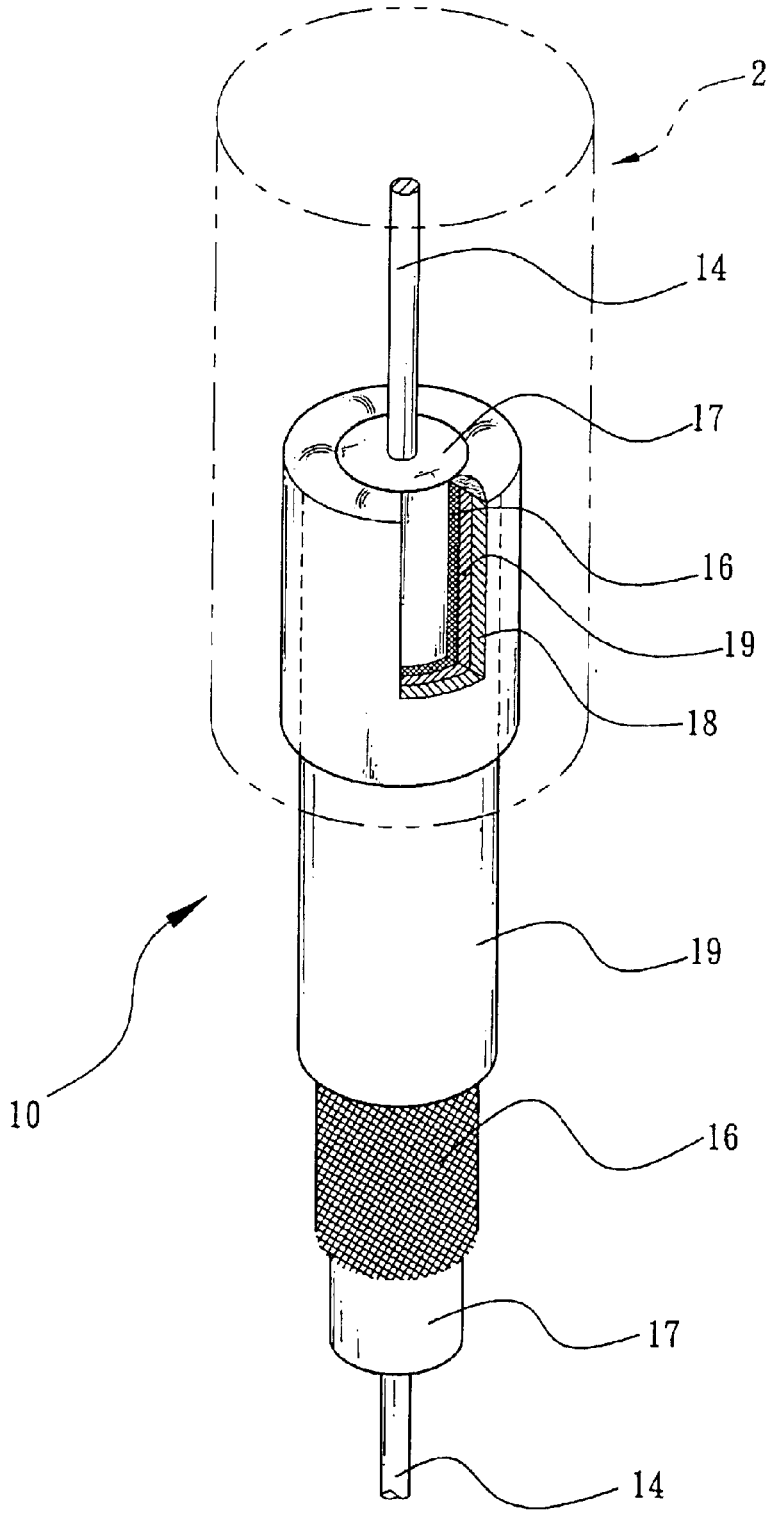
FIG. 2 (Prior Art)
FIG. 2 is an illustrative diagram of a traditional coaxial cable sleeve cable.
Figure 3:
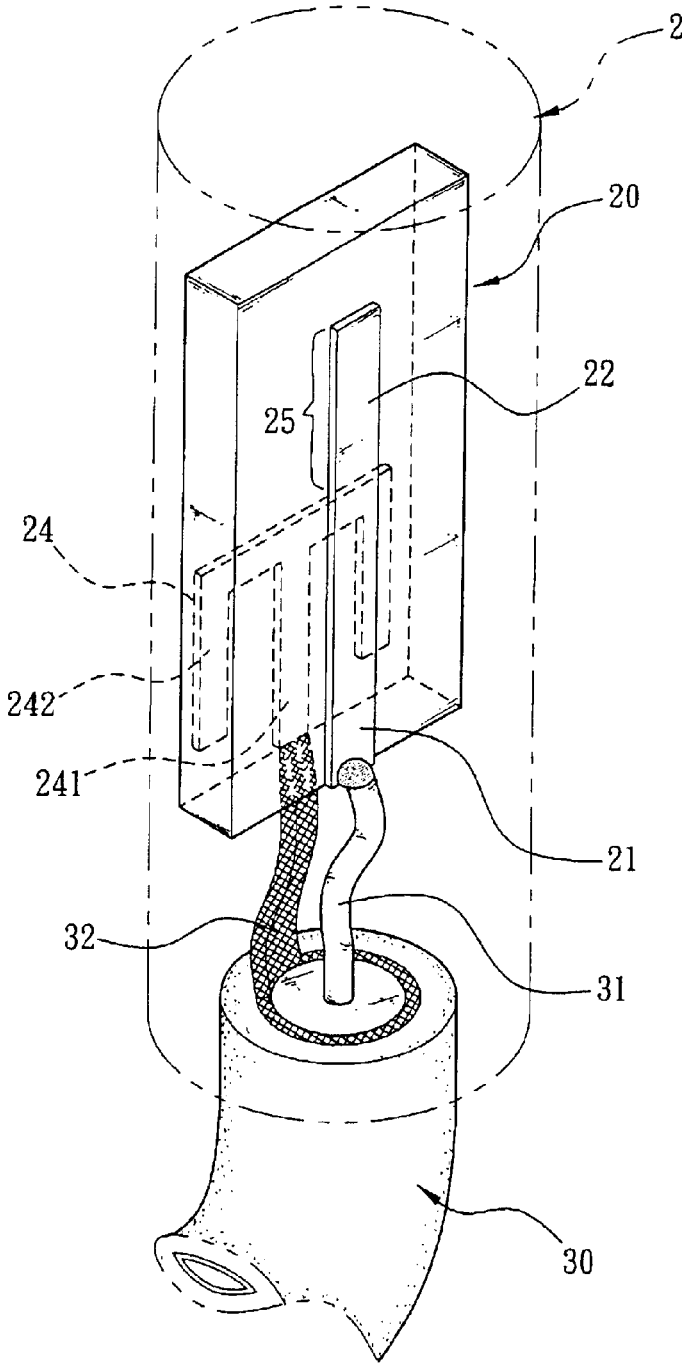
FIG. 3 (Prior Art)
FIG. 3 is an illustrative diagram of a traditional printed antenna.
Figure 4:
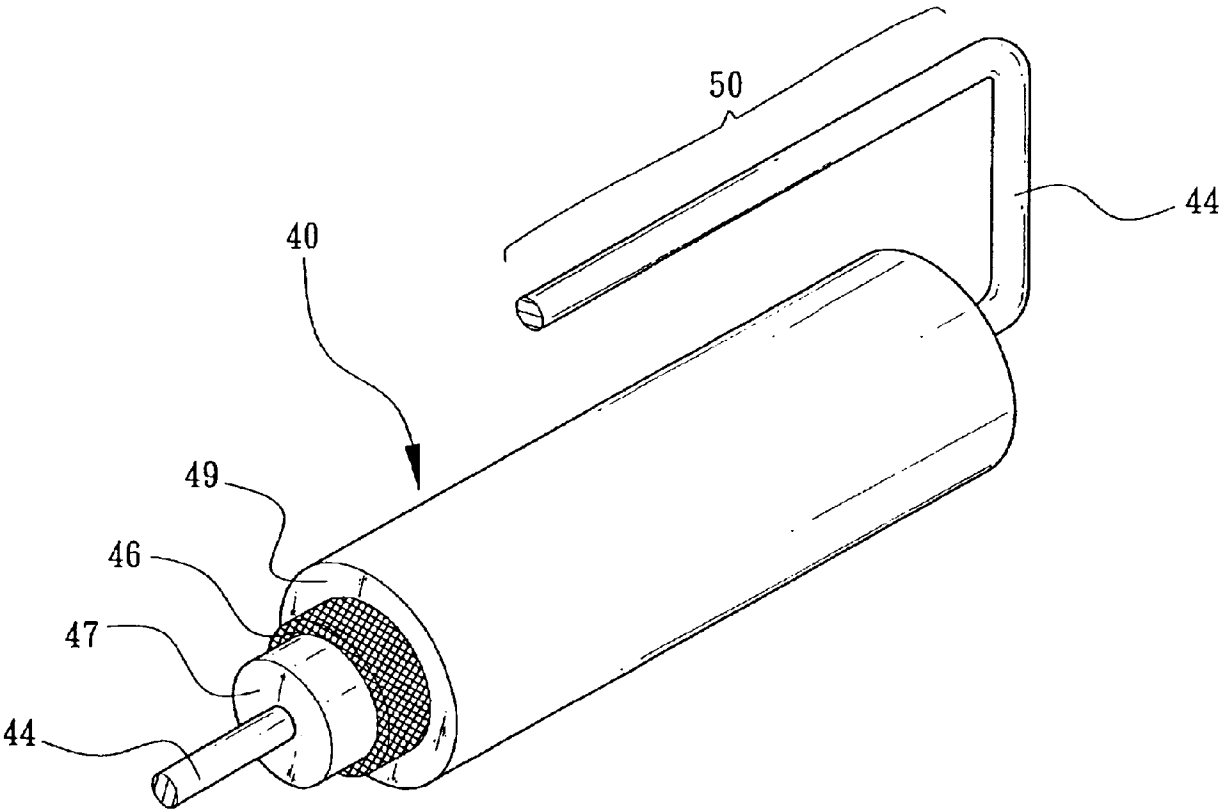
FIG. 4 is an illustrative diagram of the dipole antenna according to a preferred embodiment of the present invention.

Please refer to FIG. 4 for a preferred embodiment of the present invention, which comprises a coaxial cable 40, and the coaxial cable 40 further including an internal conductor 44 (or a symmetric axis) and an external conductor 46 (or mask or ground); an insulated dielectric material 47 disposed between the internal conductor 44 and the external conductor 46 for the isolation such that the internal conductor 44 and the external conductor 46 constitute a so-called concentric conductor in electromagnetism. Further, the external edge of the coaxial cable 40 is wrapped by an insulating external skin 49 with one end coupled to a control circuit (not shown in the figure) of the wireless communication device, and the other end has an internal conductor 44 extended to an appropriate distance from another end of the coaxial cable 40 along its axis to a predetermined distance outside the external conductor 46, and the length of such distance is controlled to the position of the resonance frequency of the dipole antenna. The internal conductor 44 is bent to approximately 90 degrees; and after being extended to a predetermined length, the internal conductor 44 is bent to approximately 90 degrees towards the adjacent external conductor 46 and parallel to the direction of the external conductor 46 and then further extended to a predetermined length on a radiating member 50, and such radiating member 50 is slightly shorter than a quarter of the wavelength of the operating frequency (¼ λ; where λ is the wavelength of the operating frequency), so that the radiating member 50 is adjacent to the external conductor 46 and keeps an appropriate distance from the external conductor 46. By controlling the distance between the radiating member 50 and the external conductor 46, an appropriate distance can be obtained to form a concentric conductor between the internal conductor 44 and the external conductor 46 in order to prevent the radiation interference produced by the leaked current on the outer side of the external conductor 46 and constitute a balance-unbalance (balun) converter to give the expected radiation effect of the aforementioned coaxial cable sleeve antenna. In the preferred embodiment of the present invention as described above as shown in FIG. 4, please note that the experiments and tests has shown that it is necessary to keep the distance between the radiating member 50 and the coaxial cable 40 of the antenna according to the present invention in the range of about 2 mm~8 mm for a better high-frequency effect.

Figure 5:
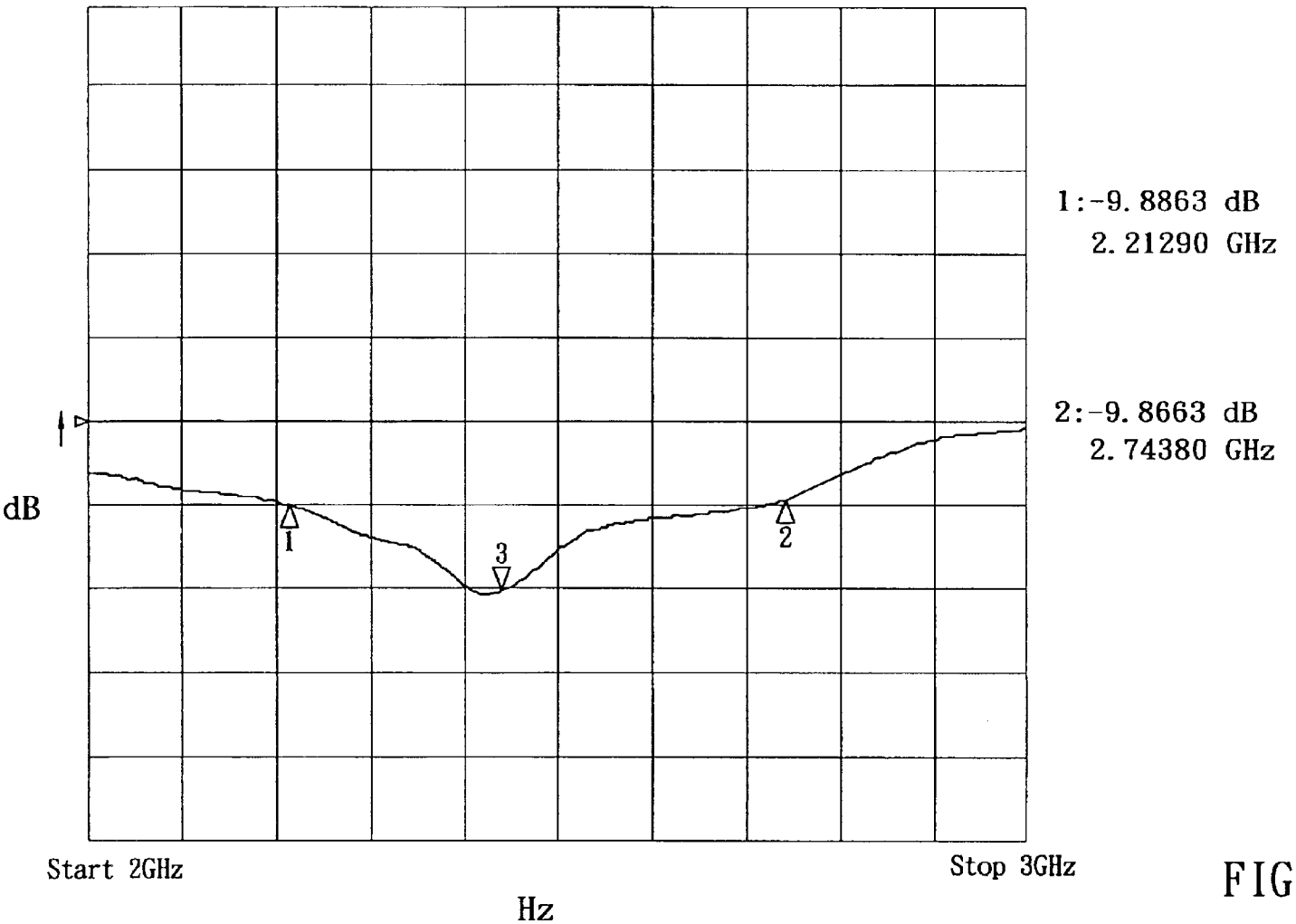
FIG. 5 is a graph of the actual measured result of the return loss according to the dipole antenna of FIG. 4.

In the embodiment of the present invention as illustrated in FIG. 4, the internal conductor 44 in the coaxial cable 40 is extended out from one end to a predetermined length outside the external conductor 46, and then bend backward in an opposite direction along the external conductor 46 and parallel to the direction of the external conductor 46 to define a radiating member 50 with a length slightly shorter than a quarter of the wavelength of the operating frequency (¼ λ; where λ is the wavelength of the operating frequency), so that the distance between the radiating member 50 and the coaxial cable 40 is kept in the range of about 4 mm~5 mm. After the antenna of the present invention is formed, such antenna is operated in the frequency range of 2.2~2.7 GHz, and the actual measurements of the return loss as shown in FIG. 5 are better than 10 dB. Therefore the design of the planar all-directional radiation field antenna according to the present invention definitely accomplishes an excellent performance within the designed range of operating frequencies.

According to the abovementioned embodiments, it is known that the antenna of the present invention requires only one coaxial cable to easily accomplish the whole structural design of the antenna without using any additional components at all, and does not require other extra manufacturing process such as soldering. Therefore, the present invention not only greatly lowers the production and manufacturing costs of the antenna, reduces the variation of production, improves the yield rate, but also effectively simplifies the working hours and procedure of the assembling to enhance the production and manufacturing efficiency. In addition, since the total length of the radiating member 50 of the antenna of the present invention is only about a quarter of the wavelength of the operating frequency, and its length is reduced to almost one half of the length of the traditional printed antenna or coaxial cable sleeve antenna. Therefore, the compact design of such antenna according to the present invention can effectively reduce the volume of wireless communication products to fit the trend for a light, thin, and small design.

What is claimed is:

1. A low-cost coaxial cable fed inverted-L antenna having a coaxial cable, and said coaxial cable comprising:

an internal conductor, being a core axis of the coaxial cable and acting as a wireless signal transmission line;

an external conductor, acting as a mask and a ground line;

an insulating dielectric material, disposed between said internal and external conductors and separating said internal and external conductors by a predetermined distance, thereby a concentric conductor being defined between said internal and external conductors;

an insulating external skin, being wrapped around the exterior of said external conductor;

wherein one end of said coaxial cable connecting to a control circuit of a wireless communication device; one end of said internal conductor being extended to a predetermined distance outside the external conductor and then bent backward in an opposite direction and along said external conductor and parallel to the direction of said external conductor, and then extended to define a radiating member with a predetermined length.

2. The antenna of claim 1, wherein said internal conductor is extended to a predetermined length and then bent backward to approximately 90 degrees and extended to another predetermined length.

3. The antenna of claim 2, wherein said internal conductor is extended to a predetermined length along the direction adjacent to said external conductor and parallel to said external conductor, and then bent to about 90 degrees to one side and then extended to a radiating member of another predetermined length.

4. The antenna of claim 3, wherein said radiating member keeps a distance of about 2 mm~8 mm from said coaxial cable.

5. The antenna of claim 3, wherein said another predetermined length of the radiating member is slightly shorter than a distance of a quarter of the wavelength of the operating frequency.

* * * * *